US007178243B2

(12) United States Patent
Brown et al.

(10) Patent No.: US 7,178,243 B2
(45) **Date of Patent: *Feb. 20, 2007**

(54) OVAL FRAME RAZOR

(75) Inventors: Frank Edward Brown, Maidenhead (GB); Brian Oldroyd, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/985,721

(22) Filed: Nov. 10, 2004

(65) Prior Publication Data

US 2005/0115073 A1 Jun. 2, 2005

Related U.S. Application Data

(63) Continuation of application No. 10/653,862, filed on Sep. 3, 2003, now Pat. No. 6,889,438, which is a continuation of application No. 09/774,044, filed on Jan. 26, 2001, now abandoned, which is a continuation of application No. 09/063,842, filed on Apr. 21, 1998, now Pat. No. 6,185,823, which is a continuation of application No. PCT/US96/18192, filed on Nov. 8, 1996.

(30) Foreign Application Priority Data

Nov. 10, 1995 (GB) ..... 9523040.5

(51) Int. Cl.
*B26B 21/00* (2006.01)

(52) U.S. Cl. ..... 30/50; 30/84; 30/76; 30/77

(58) Field of Classification Search ..... 30/50, 30/84, 77, 76, 41, 47, 41.5, 49, 34.2, 51, 30/74.1, 78, 79

See application file for complete search history.

(56) References Cited

U.S. PATENT DOCUMENTS 330,418 A 11/1885 Partridge et al.

(Continued)

FOREIGN PATENT DOCUMENTS

BE 509-715 3/1952

(Continued)

OTHER PUBLICATIONS

PCT Search Report dated Apr. 18, 1997 in corresponding PCT International application PCT/US96/18192 with examiner's indication of relevance of its foreign reference in English.

(Continued)

*Primary Examiner*—Timothy V. Eley
*Assistant Examiner*—Omar Flores-Sánchez
(74) *Attorney, Agent, or Firm*—Fish & Richardson P.C.

(57) ABSTRACT

A razor blade unit for safety razor has optimized shape and dimensions for body shaving, especially the regions of the axillae. The blade unit has an elongate blade with a rectilinear sharpened edge, and a skin contacting surface at which the length is 1 to 4 times the width and not greater than 60 mm, preferably 40 to 45 mm. The skin contacting surface has a footprint area of at least 450 $mm^2$, preferably 600 to 750 $mm^2$, and a circularity which is not less than the lower of (i) 65%, and (ii) the circularity of a rectangle with the same length and width as the skin contacting surface and with corner radii of 30% of the width. In a plane perpendicular to the blade edge the skin contacting surface is convex and shaped to make at least three point contact with an imaginary circumscribing circle with a radius of 15 to 70 mm, preferably 25 mm. Guard cap surfaces in front of and behind the blade edge each have a skin contact area of at least 140 $mm^2$, and their combined area is preferably at least 400 $mm^2$, e.g. 450 to 500 $mm^2$. A preferred shape is rectangular with semi-circular ends.

15 Claims, 9 Drawing Sheets

U.S. PATENT DOCUMENTS

| | | | |
|---|---|---|---|
| 951,036 | A | 4/1910 | Waterman |
| 1,035,308 | A | 8/1912 | Boulter |
| 1,342,028 | A | 6/1920 | Nordskog |
| 1,382,301 | A | 6/1921 | McCaffrey |
| 1,642,338 | A | 9/1927 | Holtzman |
| 1,690,557 | A | 11/1928 | Smith |
| 1,744,280 | A | 1/1930 | Peterson |
| 1,768,307 | A | 6/1930 | Bleloch et al. |
| 1,798,447 | A | 3/1931 | Behrman |
| 2,139,680 | A | 12/1938 | Heinrich |
| 2,183,554 | A | 12/1939 | Evans |
| 2,501,987 | A | 3/1950 | Brown |
| 2,547,376 | A | 4/1951 | Crawford |
| 2,712,178 | A | 7/1955 | Marzio |
| 3,477,127 | A | 11/1969 | Regan |
| 3,724,070 | A | 4/1973 | Dorian, Jr. |
| 3,783,510 | A | 1/1974 | Dawidowicz |
| 3,842,502 | A | 10/1974 | Hagan |
| 3,895,437 | A | 7/1975 | DiBuono |
| 3,934,338 | A | 1/1976 | Braginetz |
| 4,074,429 | A | 2/1978 | Roberts |
| 4,208,791 | A | 6/1980 | Van Cleve |
| 4,270,268 | A | 6/1981 | Jacobson |
| 4,285,124 | A | 8/1981 | Diakonov |
| 4,314,404 | A | 2/1982 | Ruiz et al. |
| D271,531 | S | 11/1983 | Byrne |
| 4,461,078 | A | 7/1984 | Carreker |
| 4,562,644 | A | 1/1986 | Hitchens |
| 4,712,300 | A | 12/1987 | Hemmeter |
| 4,807,360 | A | 2/1989 | Cerier et al. |
| 4,875,288 | A | 10/1989 | Trotta et al. |
| 4,901,437 | A | 2/1990 | Iten |
| 4,964,214 | A | 10/1990 | Welsh et al. |
| 4,977,670 | A | 12/1990 | Iten |
| 4,984,365 | A | 1/1991 | Leonard et al. |
| 5,031,317 | A | 7/1991 | Jacobson |
| 5,038,472 | A | 8/1991 | Iderosa |
| 5,063,669 | A | 11/1991 | Althaus |
| 5,084,968 | A | 2/1992 | Trotta |
| 5,161,307 | A | 11/1992 | Althaus |
| 5,191,712 | A | 3/1993 | Crook et al. |
| 5,199,173 | A | 4/1993 | Hegemann et al. |
| 5,208,982 | A | 5/1993 | Feruzza, Jr. |
| 5,249,361 | A | 10/1993 | Apprille, Jr. et al. |
| 5,295,305 | A | 3/1994 | Hahn et al. |
| 5,313,706 | A | 5/1994 | Motta et al. |
| 5,369,885 | A | 12/1994 | Ferraro |
| 5,416,973 | A | 5/1995 | Brown et al. |
| 5,463,813 | A | 11/1995 | Otsuka et al. |
| 5,497,550 | A | 3/1996 | Trotta et al. |
| 5,522,137 | A | 6/1996 | Andrews |
| D373,218 | S | 8/1996 | Shurtleff et al. |
| 5,557,851 | A | 9/1996 | Oritz |
| 5,579,580 | A | 12/1996 | Althaus et al. |
| 5,604,983 | A | 2/1997 | Simms et al. |
| 5,689,883 | A | 11/1997 | Oritz et al. |
| D403,811 | S | 1/1999 | Brown et al. |
| 5,903,979 | A | 5/1999 | Oldroyd |
| D415,315 | S | 10/1999 | Swanson et al. |
| 6,161,287 | A | 12/2000 | Swanson et al. |
| 6,185,823 | B1 | 2/2001 | Brown et al. |
| 6,216,345 | B1 * | 4/2001 | Andrews ..... 30/50 |

FOREIGN PATENT DOCUMENTS

| | | |
|---|---|---|
| DE | 319632 | 3/1920 |
| DE | 319 832 | 4/1920 |
| DE | 3733486 | 4/1989 |
| DE | 87 17 729.3 | 11/1989 |
| EP | 0 020 816 | 1/1981 |
| EP | 0 453 906 | 4/1991 |
| EP | 0 477 132 | 3/1992 |
| FR | 482 302 | 3/1917 |
| FR | 806 899 | 12/1936 |
| FR | 954 296 | 12/1949 |
| FR | 1503887 | 12/1967 |
| GB | 21940 | 9/1913 |
| GB | 409902 | 5/1934 |
| GB | 1157640 | 7/1969 |
| GB | 1 377 134 | 12/1974 |
| GB | 1 565 415 | 4/1980 |
| GB | 2 155 383 | 9/1985 |
| GB | 2200587 | 8/1988 |
| GB | 2 274 421 | 7/1994 |
| JP | 4-361783 | 12/1992 |
| WO | WO 91/01204 | 2/1991 |
| WO | WO 96/02369 | 2/1996 |

OTHER PUBLICATIONS

Picture of Wilkinson "Classic®" Razor alleged circa 1980's, side view in exhibit No. K9 to Nullity proceeding of Wilkinson in the matter of European patent EP 0 868 267 B1 (1 page).

Picture of package rear panel of Wilkinson "Classic" razor purchased in Germany in Jun. 2004 resembling Classic razor in "BI" above and illustrating plastic guard seat formed with the handle, a removable blade, and removable screwed on plastic top cap (1 page).

Draft German nullity request dated Jun. 14, 2004 relating to German registered patent from European EP 868 267 B1, page 1, and selected paras. 43-49 "Classic" razor (4 pages).

English translation of portions of draft German nullity request, page 1 and paras. 43-49 (3 pages).

Statement of Prof. W. Wehl summarizing measurements of "Classic" razor, in German (4 pages).

English translation of Prof. Wehl statement (4 pages).

Bic Lady Shaver in undated picture from Bicworld.com website visited Jun. 27, 2004 with Bic Product History Timeline reflecting a 1994 product date indicative of prior public use (1 page).

* cited by examiner

OVAL FRAME RAZOR

This application is a continuation application of U.S. application Ser. No. 10/653,862, filed Sep. 3, 2003, now U.S. Pat No. 6,889,438, which is a continuation application of U.S. application Ser. No. 09/774,044, filed Jan. 26, 2001, now abandonded, which is a continuation of U.S. application Ser. No. 09/063,842, filed Apr. 21, 1998, now U.S. Pat. No. 6,185,823, which is a continuation of PCT/US96/18192, filed Nov. 8, 1996, which claims priority from GB9523040.5, filed Nov. 10, 1995.

TECHNICAL FIELD

This invention relates to safety razors of the kind having a blade unit carried by a handle, the blade unit including an elongate blade with a rectilinear sharpened edge, or a plurality of such blades with parallel edges. The blade unit may be fixedly mounted on the handle with the intention that the entire razor be discarded when the blade edge or edges have become dulled. Alternatively, the blade unit can be detachably connected to the handle to enable replacement of a used blade unit with a fresh blade unit. Replaceable blade units are commonly referred to as cartridges.

BACKGROUND

There has been a general tendency over recent years for razor blade units to have been reduced in size, especially regarding the area of the surfaces which contact the skin around the blades during shaving, and the majority of blade units currently available in the marketplace are long and narrow with substantially rectangular configurations as viewed in a direction substantially perpendicular to the skin contacting surfaces. On the whole razor blade units of such shape and size have been found to provide an enhanced shaving performance in comparison with earlier blade units of larger dimensions.

The present invention is aimed specifically at a blade unit for body shaving, primarily in the axillary area. There are already on the market razors intended for use by ladies who do commonly shave their axillae, and like other razors there has been a strong trend towards making the blade units of these female razors with a narrow rectangular configuration as mentioned above. It has become the accepted thinking within the art that such blade units of narrow dimensions are especially beneficial for shaving the axillae since they will more readily fit into the rather deep concave socket of the axilla.

The present invention makes a significant departure from this current thinking in the shaving field and goes directly against all recent developments in this technical area as regards blade unit dimensions. Surprisingly, and contrary to all expectations, shaving tests have shown that not only can a blade unit of relatively large dimensions at least equal the shaving effectiveness of the smaller prior art blade units when shaving the axillae, but large blade units can be shaped to conform to the axilla region of the body so that shaving performance is not diminished, and that in terms of overall comfort large blade units have a superior performance to the prior art blade units and are preferred by users. It appears the added stability given by a large contact area with the skin gives the user greater confidence when shaving the axilla which cannot be viewed very easily during the shaving process, and as a consequence an improved comfort is perceived by the user and this more than counteracts any loss of performance due to the large contact area.

For most adult females, the underarm cavity has a minimum radius of curvature of about 25 to 30 mm. Therefore, a razor blade unit according to the invention has a length not greater than 60 mm, preferably not greater than 50 mm, and a length in the range of 40 to 45 mm is preferred. The width of the blade unit is preferably such that the aspect ratio, namely the ratio of the overall length to the overall width measured perpendicular to the blade, is in the range of 1 to 4, and in most of the preferred embodiments of the invention the aspect ratio is from 1.5 to 2.8, and more precisely in the range of 2.0 to 2.5. In the preferred embodiments the width of the blade unit is in the range of 12 to 23 mm, in particular 15 to 20 mm. Guard and cap surfaces are defined in front of and behind the blade or blades for contact with the skin in front of and behind the blade or blades during shaving, and preferably each of the guard and cap surfaces has a width of not less than 4.0 mm, at least where the width of the blade unit is at a maximum. The guard and cap each has a skin contact area which is preferably not less than 140 mum2, and the combined skin contact areas of the cap and guard are preferably at least 400 $mm^2$, and most preferably in the range of 450 to 500 $mm^2$. As the blade unit of the present invention is rather wide, in order to facilitate contact with the skin in the axilla over at least most of the guard and cap areas, as viewed in cross section in a plane perpendicular to the blade edges, the skin contacting surface is made convex. It is important to understand that the word "convex" as used in the present specification does not necessarily mean that the skin contacting surface is smoothly curved and it implies only that the guard and cap surfaces extend upwardly in the direction from their edges remote from the blade or blades so that the blade edge or edges are at a level above the remote edges of the cap and guard surfaces. More particularly, a straight line joining the outer and inner limits of each of the guard and cap surfaces is inclined at an angle of at least 5°, and possibly up to 25°, to a plane which is tangential to the skin contacting surfaces immediately in front of and behind the blades.

In the preferred embodiments the angle of inclination is in the range of 10° to 20° degrees, and more specifically substantially equal to 15°. By virtue of the convexity of the skin contacting surface, the blade unit is preferably shaped to make at least three point contact with an imaginary circumscribing circle having a diameter of from 30 to 100 mm, and preferably of about 50 mm whereby it will be ensured that the blade unit convexity will at least approximately conform to that of the axilla.

An important aspect of the blade unit according to the invention is that it defines a large area over which contact can be made with the skin during shaving, and a circumscribing perimeter extending about the skin contacting surface confines an area, referred to hereinafter as the "footprint area", of at least 450 $mm^2$. The most preferred footprint area is in the range of 600–750 $mm^2$, and more specifically between 650 and 720 $mm^2$.

Since the invention proposes a blade unit with a long and wide shape, a substantially rectangular configuration with sharp angled corners, at least at the edge adjacent the guard surface, is inappropriate.

For the purposes of the present specification a sharp angled corner may be considered to be an angle less than about 120° with a radius of curvature less than around 3 mm. Preferably the curvature at any corner is at leastSmm. The unacceptability of a substantially rectangular configuration and the objective of providing a large skin contact area means that the blade unit needs to be profiled, as seen in plan generally perpendicular to the skin contacting area, to obtain a relatively large area within the confines of the overall length and width dimensions. The "circularity" of a two dimensional shape is a convenient way of relating the area enclosed by its perimeter to the length of the perimeter, and expressing it in terms of a percentage compared with a circle which always provides the maximum area for any given perimeter length. Thus, the circularity for any shape is defined by the equation:

$$\text{Circulatory}=A/P^2\times 4\pi\times 100,\ \text{where } A=\text{the area and } P=\text{the perimeter.}$$

Razor blade units according to the present invention have a circularity not less than the lower of (a) 65%, and (b) the circularity of a substantially rectangular area having the same length and width as the skin contacting area and having corner radii of 30% of said width. Preferably the circularity is greater than that of a rectangle with the same overall length and width and rounded corners with radii equal to 10% of the length. For blade units with a low aspect ratio, i.e., less than about 3, the lower limit (a) will apply, although even in the case of these blade units it is preferable that the circularity also exceeds limit (b). Acceptable oval blade units with an aspect ratio above 3.25 may have a circularity of less than 65%. Preferred embodiments with aspect ratios below about 2.75 have a circularity greater than 70%, and more particularly in the order of 80%. Typical prior art blade units have a circularity of less than 65%.

The comparatively large circularity of a blade unit according to the invention can be achieved with rounded corners at the ends of the blade unit with relatively large radii of curvature of at least 6 mm, or with oval, elliptical or polygonal shapes which need not necessarily be symmetrical.

Having regard to the foregoing, the present invention resides in a razor blade unit comprising at least one elongate blade having a rectilinear sharpened edge and mounted in a substantially inflexible carrier, a skin contacting surface surrounding the blade edge(s) and including guard and cap surfaces on opposite sides of the blade edge(s), the aspect ratio of the length to width of the skin contacting surface being in the range of from 1 to 4, as seen in cross section in a plane perpendicular to the blade edge(s) the skin contacting surface being convex, the overall length of the blade unit at the skin contacting surface being not greater than 60 mm, the skin contacting surface having a circumscribing perimeter confining a footprint area of at least 450 $mm^2$, and the circumscribing perimeter being so shaped that the footprint area confined by said perimeter has a circularity (as herein above defined) not less than the lower of (a) 65%, and (b) the circularity of a substantially rectangular area having the same length and width as the footprint area of the skin contacting surface and having corner radii of 30% of said width, and the edge of the blade unit adjacent the guard surface being free of sharp angled corners.

A razor equipped with a blade unit as described above has been found in shave tests to achieve a significantly improved overall performance in shaving the axilla and has also been found to be very effective in shaving other body areas, such as the legs.

It should be understood that unless otherwise stated, all dimensions and areas quoted herein are measured in a projected plane and as seen in plan view so the effect of the convex curvature of the skin contacting surface of the blade unit has not been taken into account in determining the relevant dimensional data.

BRIEF DESCRIPTION OF THE FIGURES

To further illustrate the invention some forms of razor blade unit shaped and dimensioned in accordance with the invention will now be described with reference to the accompanying drawings, in which.

DETAILED DESCRIPTION OF PREFERRED EMBODIMENTS

Figure 14:
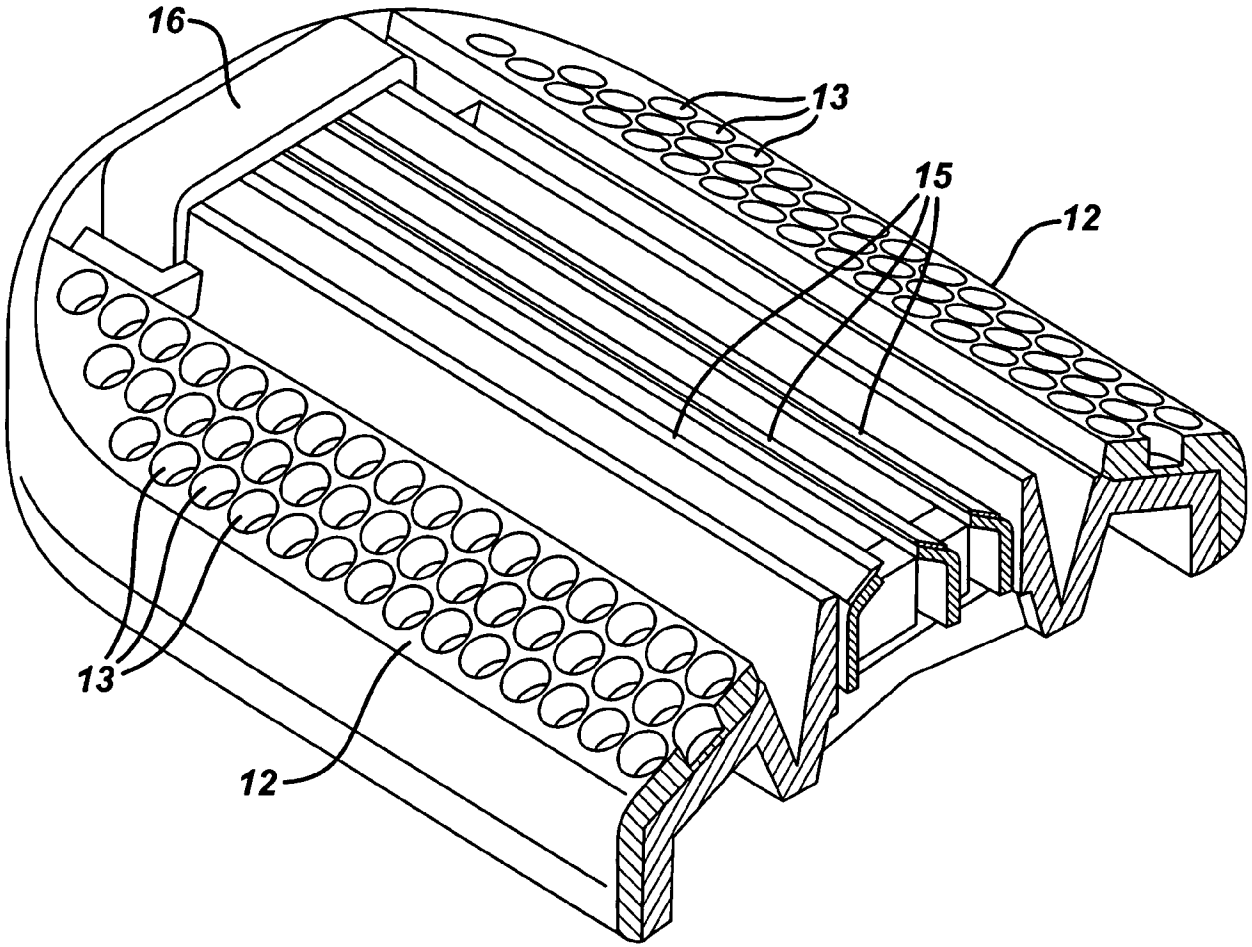
FIG. 14 illustrates in partial perspective view a blade unit as shown in FIG. 1 and having guard and cap surfaces similar to those of the FIG. 13 embodiment.
Figure 15:
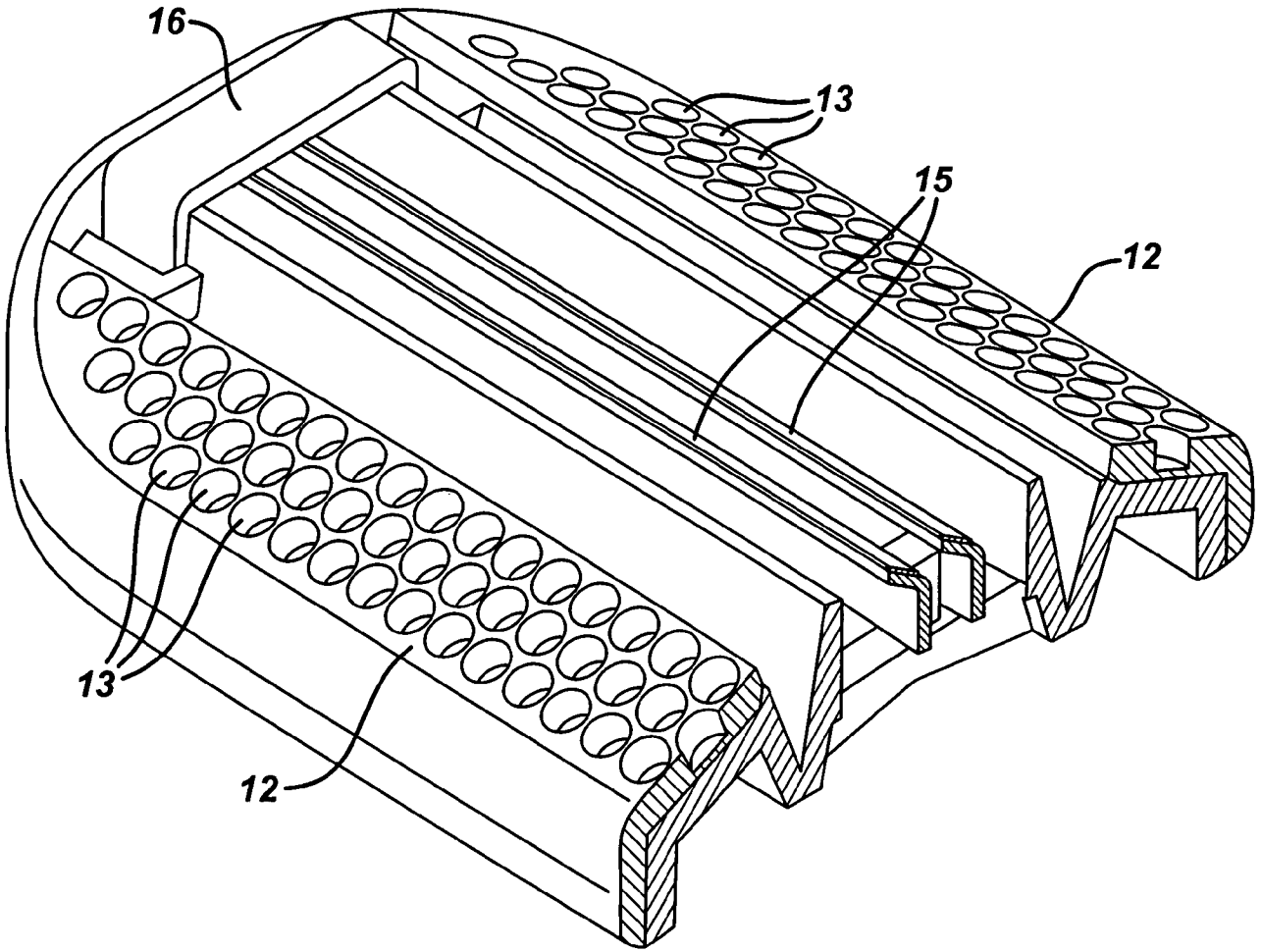
FIGS. 15 and 16 are views corresponding to FIG. 14 showing blade units with two and three forwardly facing blades, respectively.
Figure 16:
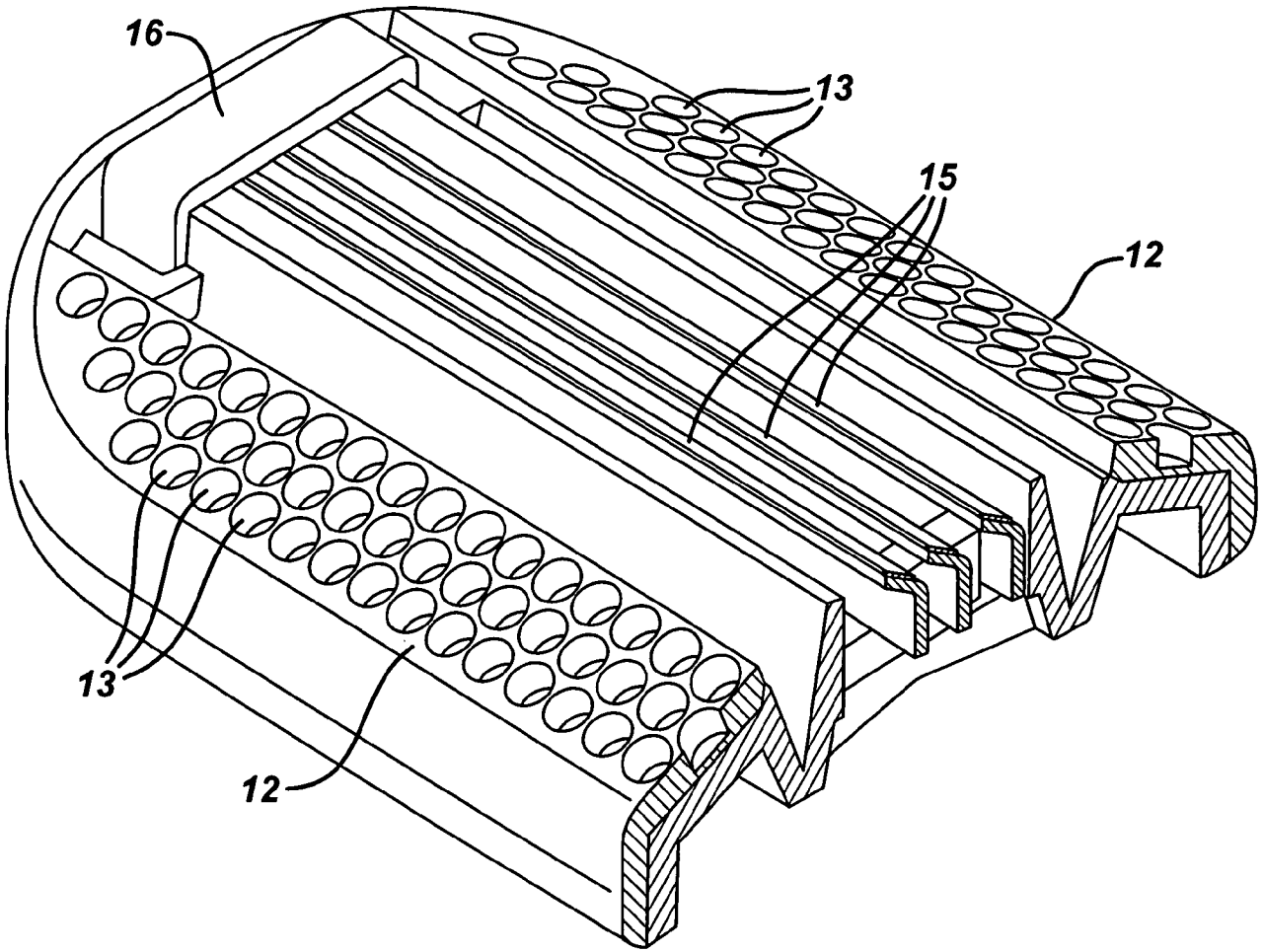

Each of the blade units shown in FIGS. 1 to 9 will comprise a blade housing which incorporates a substantially inflexible blade carrier frame conveniently moulded from plastics material. The housing defines a skin contact area surrounding an elongate rectangular aperture 2 in which a blade (not shown in FIGS. 1–9) with a sharp rectilinear edge is mounted. A single blade may be provided, but preferably two or more blades with parallel sharpened edges are mounted in the aperture 2. In the particular embodiment shown in FIG. 14, there are three blades, two facing forwardly and one facing rearwardly so that the razor blade unit will shave in both directions although forward movement across the skin will generally provide a slightly better result. FIG. 15 shows an embodiment with two blades in tandem, and FIG. 16 shows another embodiment with three blades with parallel edges all facing in the forward direction. Each of the blade units of FIGS. 1 to 9 may be regarded as being adapted to receive two blades, or three blades mounted similarly to the blades in FIG. 14 or all in tandem. The blade housing in each of the embodiments shown in FIGS. 1 to 9 has a guard area 3, which is located forwardly (below as viewed in the drawings) of the blade aperture, and a cap area 4 behind (above in the drawings) of the blade aperture 2.

Figure 1:
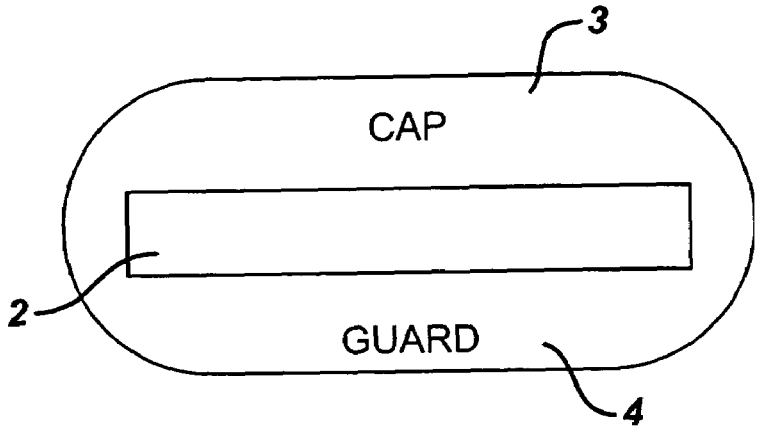
FIGS. 1 to 9 are schematic plan views of razor blade units embodying the invention.

The particular blade unit of FIG. 1 is oval and has the shape of a rectangle with semicircular ends. The dimensions as measured in the projected plan view as illustrated are as follows:

| | |
|---|---|
| Overall length = | 42.0 mm |
| Overall width = | 18.0 mm |
| End radius = | 9.0 mm |
| Guard area = | 206 $mm^2$ |
| Cap area = | 277 $mm^2$ |
| Total skin contact area = | 504 $mm^2$ |
| Total footprint area within perimeter = | 686 $mm^2$ |

Figure 2:
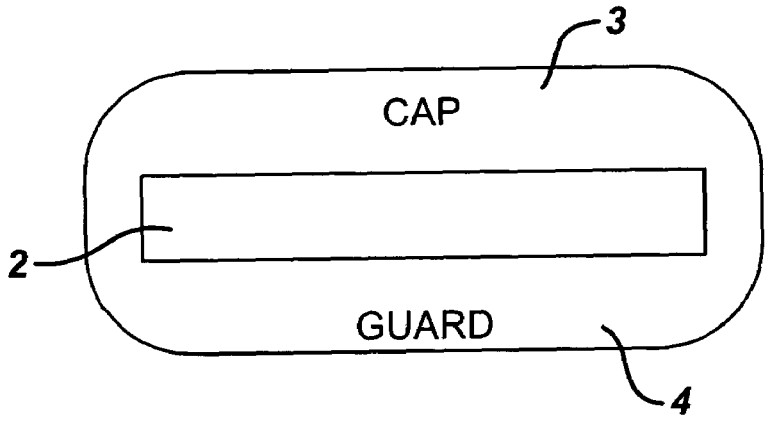

The blade unit of FIG. 2 is approximately rectangular with corners of large radii of curvature. The particular dimensions for this embodiment are:

| | |
|---|---|
| Overall length = | 41.0 mm |
| Overall width = | 18.0 mm |
| Corner radius = | 6.0 mm |
| Guard area = | 213 $mm^2$ |
| Cap area = | 286 $mm^2$ |
| Total skin contact area = | 520 $mm^2$ |
| Total footprint area within perimeter = | 703 $mm^2$ |

Figure 3:
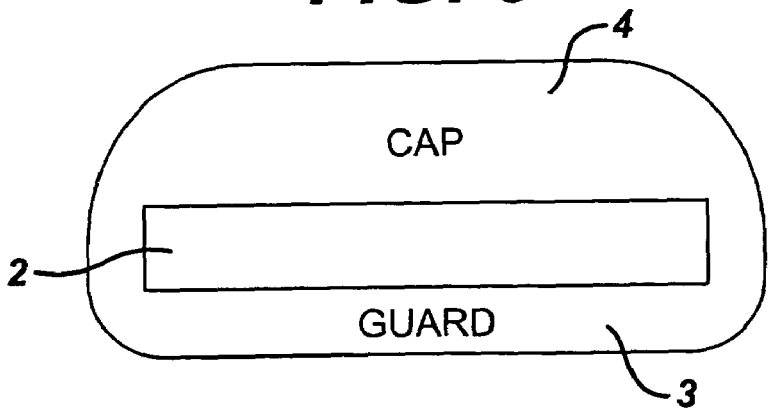

FIG. 3 illustrates a blade unit of asymmetric configuration. At the ends of the front edge of the blade unit housing are rounded corners of large radius (as in ~FIG. 2), and the corners at the ends of the rear edge are rounded with a substantially greater radius of curvature. The specific dimensions are:

| | |
|---|---|
| Overall length = | 40.0 mm |
| Overall width = | 18.0 mm |
| Front end corner radius = | 6.0 mm |
| Rear end radius = | 10.0 mm |
| Guard area = | 185 $mm^2$ |
| Cap area = | 283 $mm^2$ |
| Total skin contact area = | 488 $mm^2$ |
| Total footprint area within perimeter = | 668 $mm^2$ |

Figure 4:
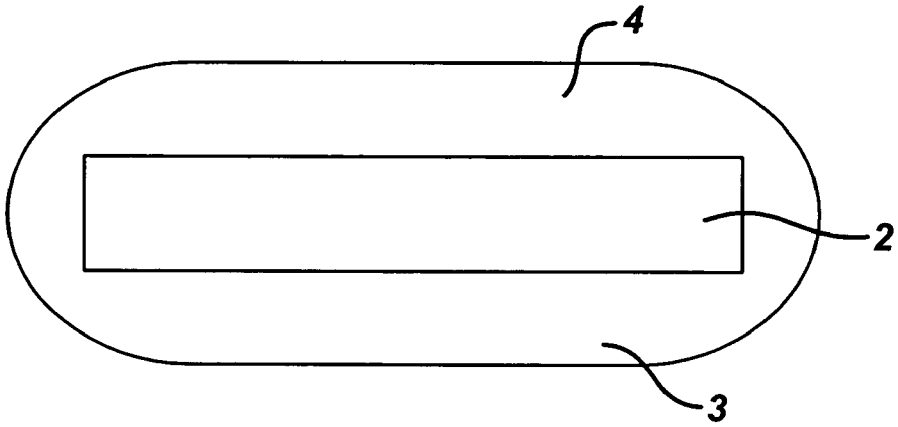
Figure 5:
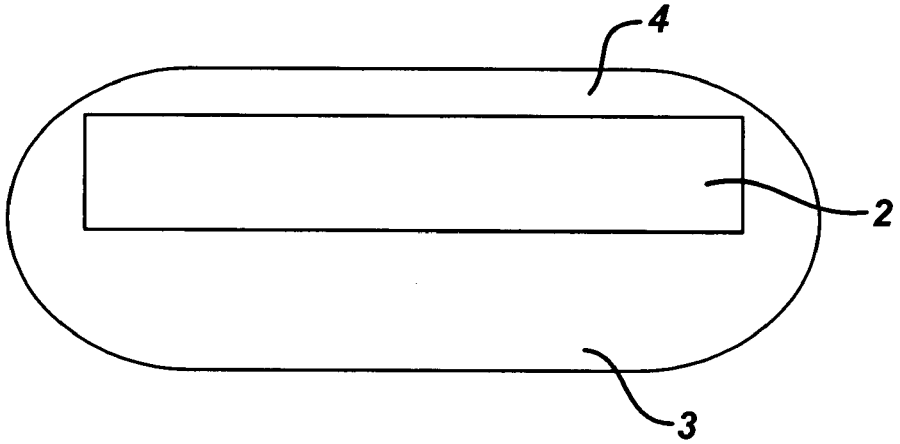
Figure 6:
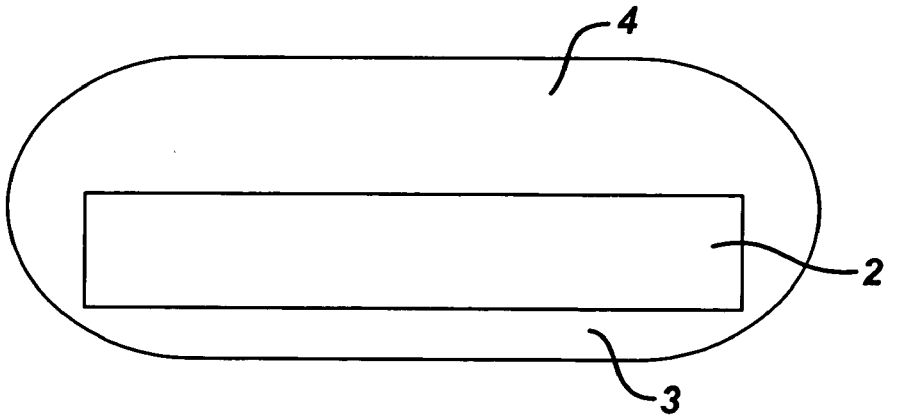

FIGS. 4–6 show blade units with housings of the same overall shape and size of that shown in FIG. 1, but the position of the blade aperture is different. In FIG. 4 the aperture is located so that the guard and cap areas are equal, whereas in FIG. 5 it is positioned so that the cap area is substantially smaller than the guard area (but still at least 140 $mm^2$) and in FIG. 6 it is positioned so that the guard area is substantially smaller than the cap area (but still at least 140 $mm^2$).

Figure 7:
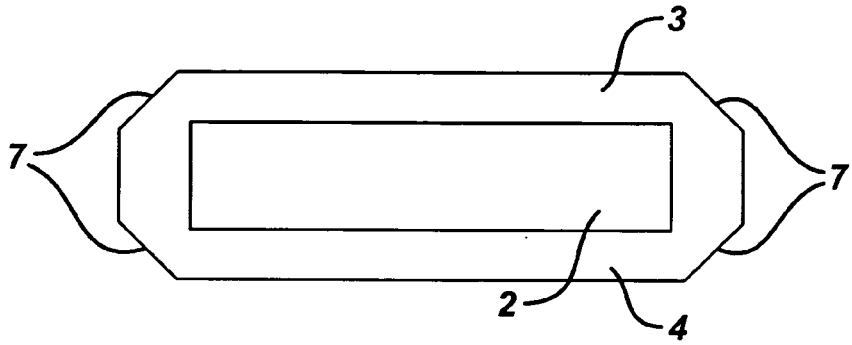

FIG. 7 illustrates a polygononal blade unit shaped essentially as a rectangle with chamfered corners 7 with faces at 135° to the longitudinal front and rear sides and to the ends. In the case of a blade unit of overall length 42 mm and overall width 18 mm, the chamfers may lie along the diagonals of squares measuring 5 mm×5 mm.

Figure 8:
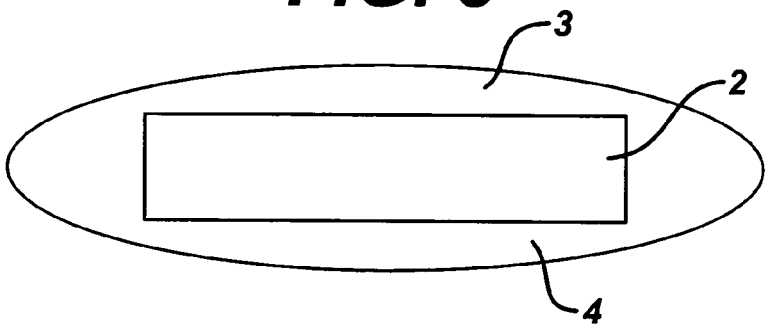
Figure 9:
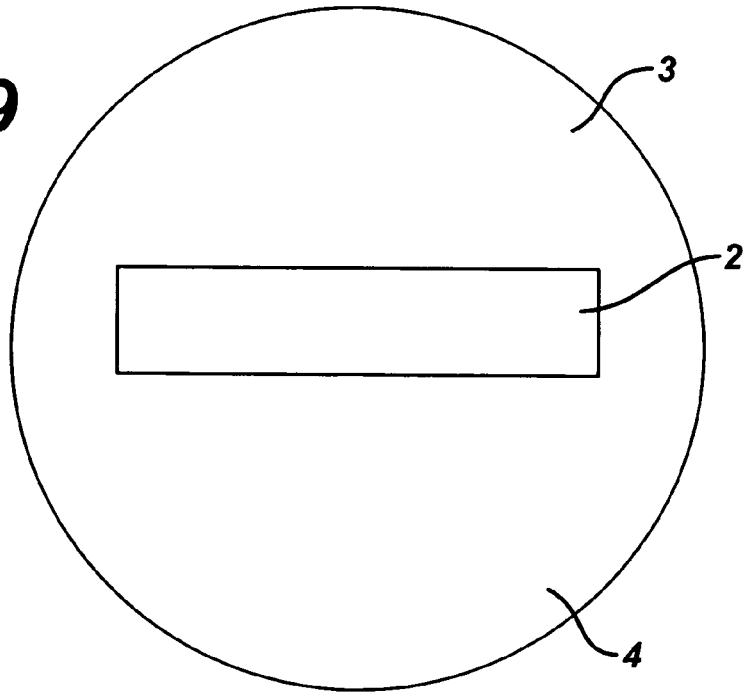

All the embodiments of FIGS. 1–7 have rectilinear front and rear edge portions which, at least over a major part of the blade length are parallel to the blade edge(s). This can be desirable to ease orientation of the blade unit and assist the user in knowing in which direction the blade unit should be moved over the skin. It is not essential, however, and the dimensional criteria of a blade unit embodying the invention can be obtained with other configurations. FIG. 8, for example shows a blade unit of elliptical outline, and even a circular shape as shown in FIG. 9 is possible although it is not the most desirable embodiment.

Figure 10:
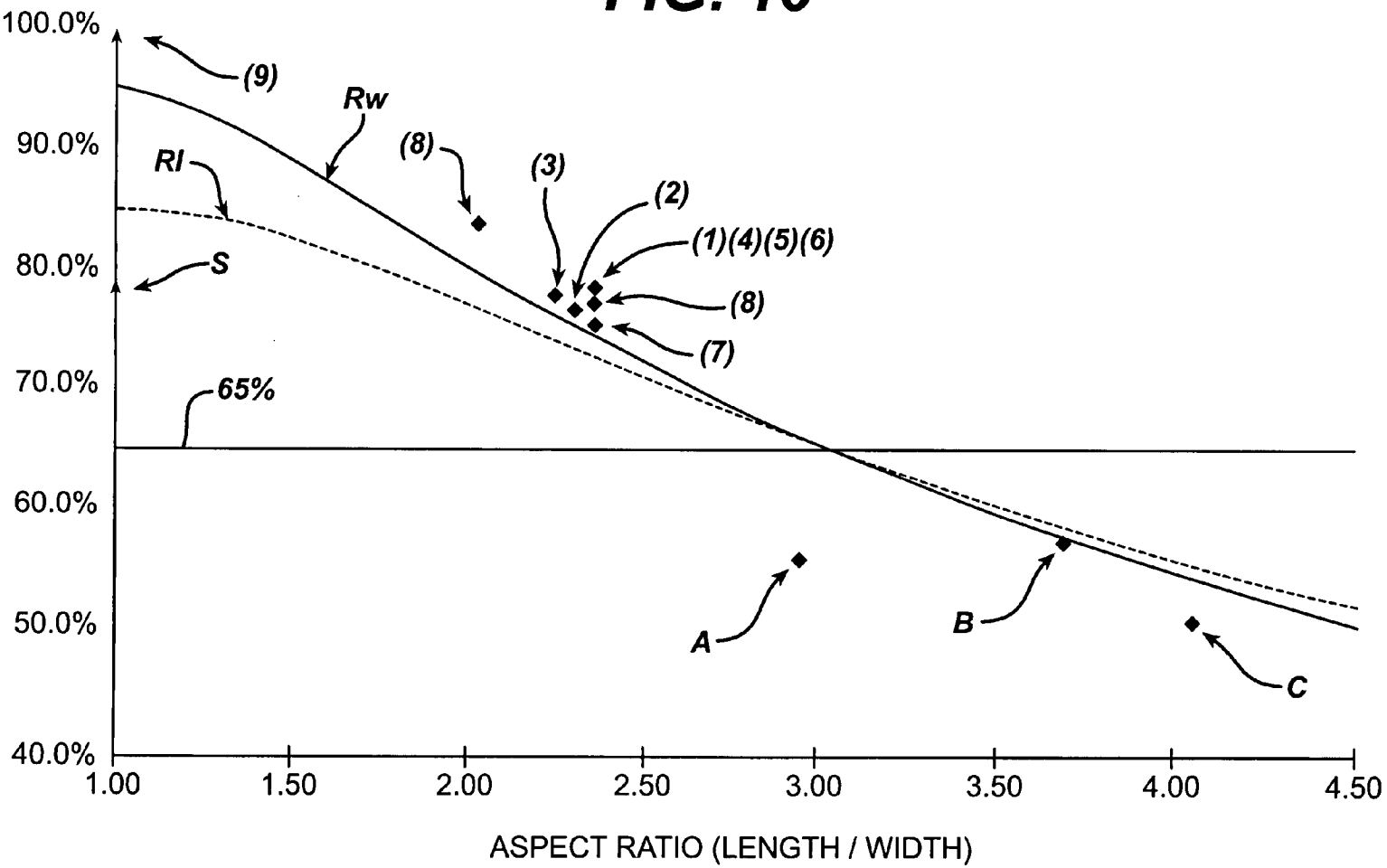
FIG. 10 is a graph showing circularity plotted against aspect ratio (maximum length/maximum width) and showing the results for the blade units of FIGS. 1 to 9 and for some prior art blade units.

FIG. 10 shows a graph showing circularity plotted against aspect ratio, i.e. the maximum length/maximum width of the blade unit. The points representative of the blade units of FIGS. 1–9 are indicated (1) . . . (9), the points representative of three prior art female razor blade units currently marketed are indicated A, B and C, and the point representative of a square is indicated S for comparison purposes. The line $R_W$ which extends generally diagonally across the graph is representative of rectangles with corner radii of 30% of the rectangle width. The dotted line $R_L$ is representative of rectangles with corner radii of 10% of the rectangle length. The horizontal line is drawn at a circularity of 65%. It can be seen that all the preferred embodiments of the invention denoted on the graph have aspect ratios between 1.5 and 2.8, and for the majority the aspect ratio is in the range of 2.0 to 2.5. Furthermore, the embodiments of the invention have circularity greater than the circularity of a corresponding rectangle with the same aspect ratio and having corners rounded at a radius of 10% of the rectangle length ($R_L$) or of 30% of the rectangle width ($R_W$). In addition, the embodiments of the invention have greater circularity than the prior art blade units and those included on the graph all have values above 60%, and more especially above 70%. (It may be noted that there are two points (8) shown in FIG. 10 to depict two alterative elliptical shapes).

Figure 11:
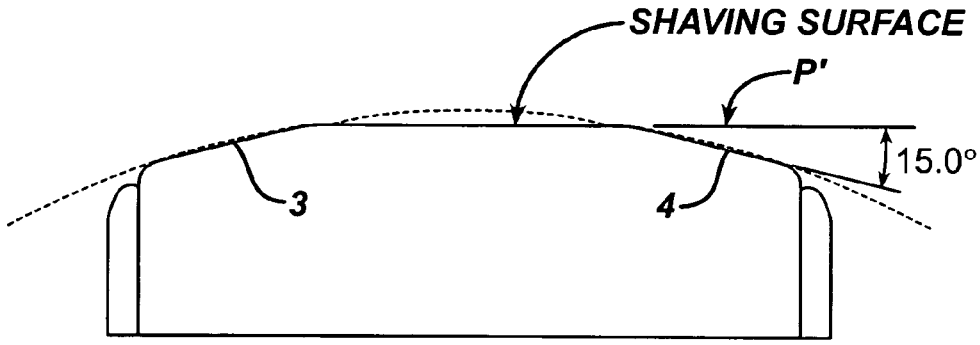
FIG. 11 is a schematic cross-section through the blade unit of FIG. 1.
Figure 12:
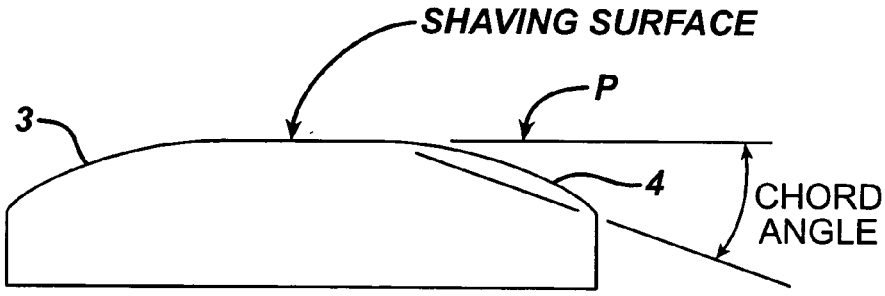
FIG. 12 illustrates a modified shape of guard and cap surfaces for the blade unit of FIG. 1.

In all of the embodiments of the invention the skin contacting surfaces are not flat and the views of FIGS. 1 to 9 are merely the projected plan areas. The surfaces are preferably shaped to make at least three point, and ideally at least four point contact with an imaginary circumscribing circle with a radius of 25 mm. FIG. 11 shows this preferred relationship for a blade which could, for example, be the blade unit of FIG. 1. The imaginary circle is drawn in dotted line, and it can be seen that the cap and guard surfaces are in substantial conformity with this circle. In FIG. 11 the guard and cap surfaces are essentially flat, but they could be convexly curved to provide even closer conformity, e.g. as depicted in the schematic illustration of FIG. 12. The cap and guard surfaces are inclined to a plane P, which is the "shaving surface" tangential to the skin contact surfaces immediately in front of and behind the blade(s), at an angle which is 15° in the exemplary embodiment illustrated. In any particular embodiment the most appropriate inclination angle will depend on the blade unit width and will be chosen accordingly, but for most embodiments of the invention at least, an angle in the range of 100 to 200 will be required to ensure close conformity with the imaginary circle. In the case of a convex guard and/or cap surface, as in FIG. 12, it will be appropriate to consider the inclination of a chord line intersecting the edges of the surface in question nearest and most remote from the adjacent blade.

Figure 13:
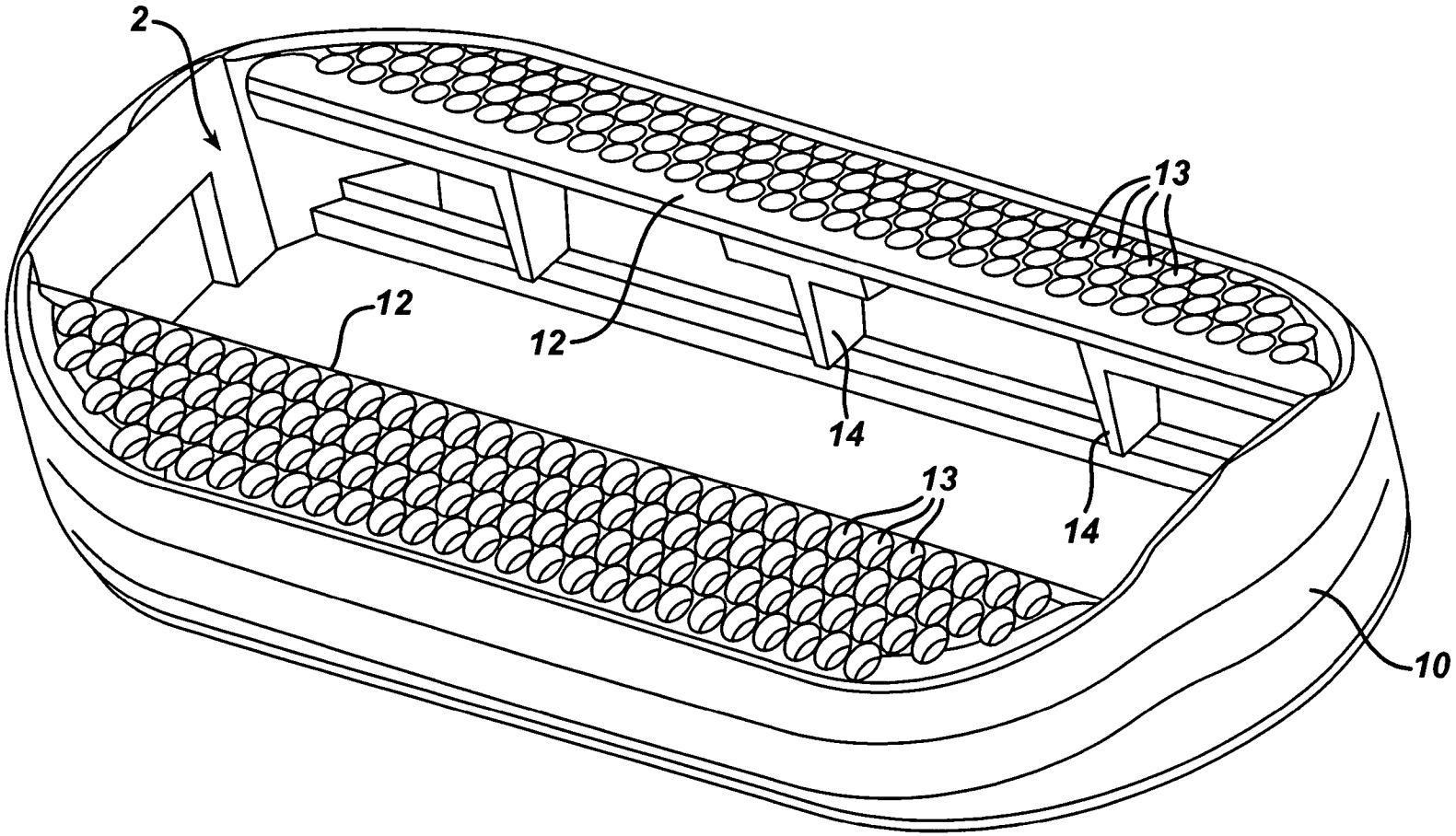
FIG. 13 illustrates in perspective a blade housing of a blade unit as shown in FIG. 1.

In FIG. 13 there is illustrated a preferred form of blade unit housing. It has a frame 10 defining an aperture 2 to accommodate the blades and the components which fix them in the frame. Mounted on the frame are guard and cap components each having an elastomeric surface element 12 defining a skin contact area formed with an array of cylindrical pockets 13 evenly distributed over essentially the entire surface area. For ease of manufacture and assembly the elastomeric element is moulded onto a support 14 which is firmly fastened in the frame 10. FIGS. 14, 15 and 16 show a modified construction wherein the elastomeric elements 12 are carried directly by the frame of the blade unit. These figures also shows the brades 15 fitted within the frames, and one of the securing clips 16 which are provided at each end of the blade unit to retain the blades in place.

It is important to note that, as previously mentioned, all the dimensions quoted in the description and claims of this specification regarding length, width and area are based on the profile of the blade unit skin contacting surface projected onto a plane which is parallel to the plane of the shaving surface i.e. the plane denoted P in FIG. 11. In addition, when calculating the circularity, any minor irregularities in the perimeter, e.g. due to small indentations, such as narrow notches or projections which can significantly change the perimeter without substantially changing the area, should be disregarded.

What is claimed is:

1. A replaceable safety shaving assembly for attachment to a razor handle, comprising a carrier molded of plastic;

a plurality of elongate blades mounted in the carrier, wherein each blade comprises a longitudinally elongate sharpened edge;

a skin contacting surface surrounding the elongate blades and comprising a guard surface and a cap surface, wherein the guard surface comprises an elastomeric material mounted on the carrier at a front end of the shaving assembly, the cap surface is mounted on the carrier at a back end of the shaving assembly, and the plurality of blades is located between the guard surface and the cap surface; wherein the plurality of blades, the carrier, and the guard and cap surfaces are attachable as a unit to a razor handle;

the shaving assembly comprises a width of about 12 to about 23 mm, a length of about 40 to about 45 mm, and a ratio of length to width of about 1.5:1 to about 2.8:1; and the skin contacting surface confining a footprint area of at least 450 $mm^2$.

2. The shaving assembly of claim 1, wherein the blades are arranged with their sharpened edges all facing the forward end of the shaving assembly.

3. The shaving assembly of claim 1, wherein the width of the shaving assembly is about 15 to about 20 mm.

4. The shaving assembly of claim 1, in combination with a razor handle.

5. The shaving assembly of claim 1, wherein the plurality of blades comprises at least three blades mounted in the carrier.

6. The shaving assembly of claim 1, wherein said carrier is substantially inflexible.

7. The shaving assembly of claim 1, wherein the guard and cap surfaces each intersect an essentially flat surface.

8. The shaving assembly of claim 1, further comprising a handle-receiving mounting structure.

9. The shaving assembly of claim 1, wherein the cap surface area is approximately the same as the guard surface area.

10. The shaving assembly of claim 1, wherein the cap surface area is smaller than the guard surface area.

11. The shaving assembly of claim 1, wherein the cap surface area is larger than the guard surface area.

12. The shaving assembly of claim 1, wherein the skin contacting surface is approximately symmetric about a medial transverse plane.

13. The shaving assembly of claim 1, further comprising an elongate ledge molded of plastic material and disposed between a sharpened edge of a forwardmost blade and the skin-engaging guard surface.

14. The shaving assembly of claim 1, further comprising an elongate ledge molded of plastic material and disposed between a back edge of a rearwardmost blade and the skin-engaging cap surface.

15. The shaving assembly of claim 1, wherein the shaving assembly is formed as a cartridge.

* * * * *

UNITED STATES PATENT AND TRADEMARK OFFICE

CERTIFICATE OF CORRECTION

PATENT NO. : 7,178,243 B2
APPLICATION NO. : 10/985721
DATED : February 20, 2007
INVENTOR(S) : Frank Edward Brown and Brian Oldroyd It is certified that error appears in the above-identified patent and that said Letters Patent is hereby corrected as shown below:

On the Cover Page, item [56] under "References Cited U.S. Patent Documents", replace "11/1885" with --3/1910--.

On the Cover Page, item [56] under "References Cited U.S. Patent Documents", replace "3/1950" with --11/1945--.

Signed and Sealed this

Seventeenth Day of June, 2008

JON W. DUDAS
*Director of the United States Patent and Trademark Office*